US007331839B2

(12) United States Patent
Diffley

(10) Patent No.: US 7,331,839 B2
(45) Date of Patent: Feb. 19, 2008

(54) FLOATING WATER TOY

(76) Inventor: Brett J. Diffley, 29288 218th Pl. SE., Black Diamond, WA (US) 98010

( * ) Notice: Subject to any disclaimer, the term of this patent is extended or adjusted under 35 U.S.C. 154(b) by 433 days.

(21) Appl. No.: 10/687,778

(22) Filed: Oct. 16, 2003

(65) Prior Publication Data

US 2005/0085155 A1 Apr. 21, 2005

(51) Int. Cl.
*A63H 33/00* (2006.01)
*A63H 23/00* (2006.01)

(52) U.S. Cl. ..... 446/153; 446/26; 446/176

(58) Field of Classification Search ..... 446/153, 446/220, 223, 226; 222/78, 79; 239/211, 239/289; 441/131, 132, 136, 129, 124, 111, 441/112; 273/349, 350; 472/128, 129
See application file for complete search history.

(56) References Cited

U.S. PATENT DOCUMENTS 4,223,894 A * 9/1980 Fabricant ..... 222/78
4,642,822 A * 2/1987 Tvengsberg ..... 472/128
4,910,806 A * 3/1990 Baker et al. ..... 2/452
5,219,307 A * 6/1993 Morrison ..... 441/38
5,605,485 A * 2/1997 Spector ..... 222/79
5,609,507 A * 3/1997 Spector ..... 446/72
D380,506 S * 7/1997 Matthews ..... D21/572
5,664,258 A * 9/1997 Harris ..... 2/84
6,027,393 A * 2/2000 O'Rourke ..... 446/153
6,415,451 B1 * 7/2002 Waller ..... 2/428
6,419,545 B1 * 7/2002 Motosko ..... 446/176
2002/0042943 A1 * 4/2002 Waller ..... 2/428
2003/0068505 A1 * 4/2003 Gines et al. ..... 428/447

* cited by examiner

*Primary Examiner*—Eugene Kim
*Assistant Examiner*—Urszula M Cegielnik
(74) *Attorney, Agent, or Firm*—Delbert J. Barnard

(57) ABSTRACT

The lower portion (12) of a water toy (10) is buoyant and floats on a body of water (FIG. 1). An upper portion (14) of the toy includes an inner cavity (32) sides to receive the head (34) of a user. The user sights through a sight opening (30) in the upper portion (14). The user's hands are on the controls (64) for a pair of water guns (38,40). When the user depresses the triggers (54) the water guns (38,40) pump water up through the water guns (38, 40) and discharge the water in the form of streams at some target selected by the user. The upper portion (14) is inflatable to give it stand up rigidity.

9 Claims, 3 Drawing Sheets

FIG. 3
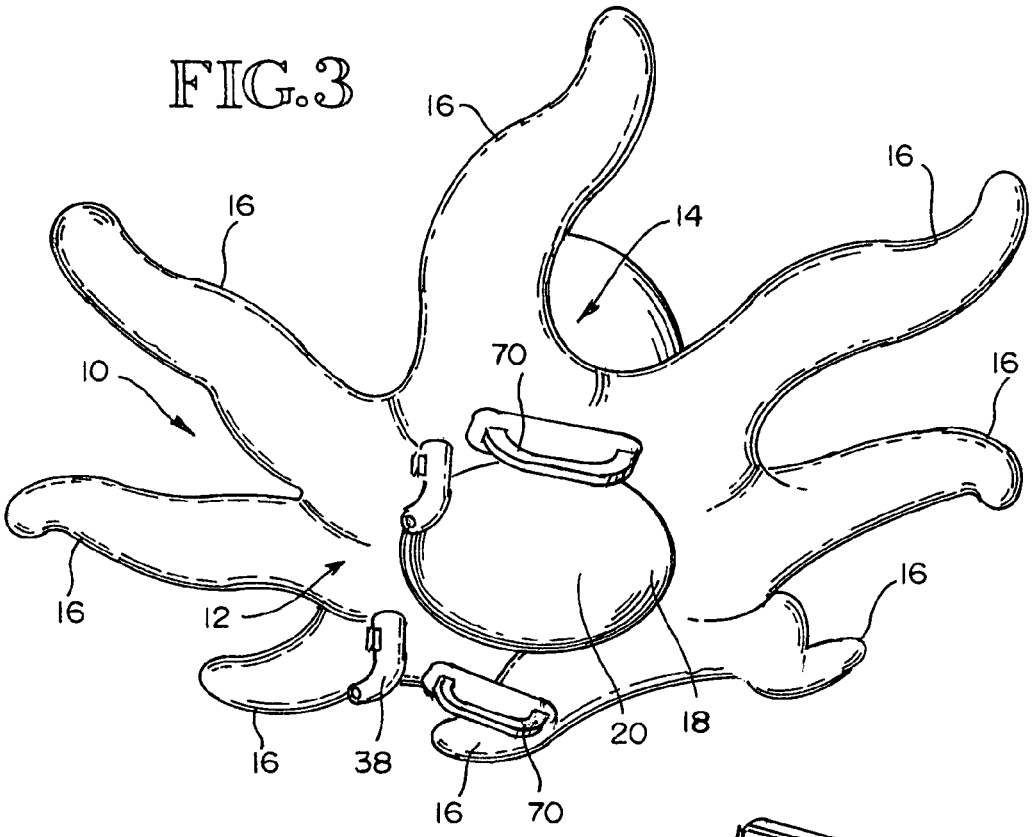
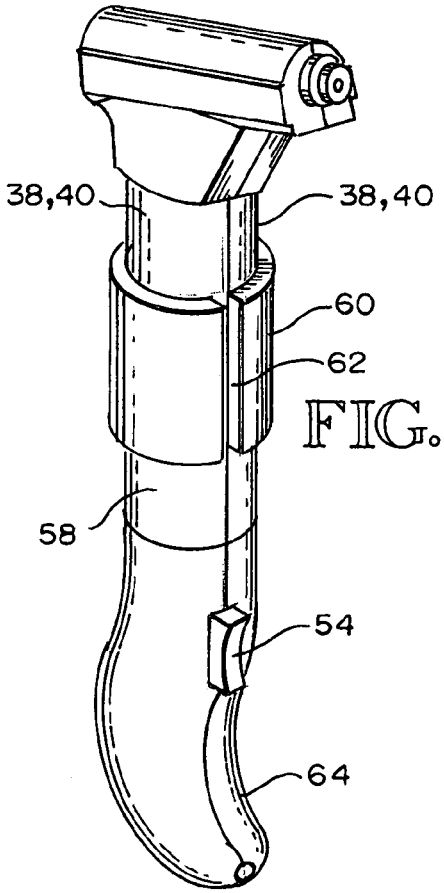
FIG. 4
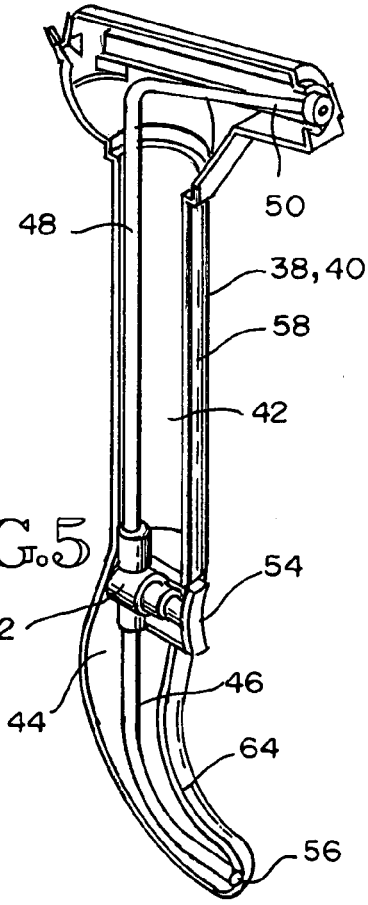
FIG. 5

FLOATING WATER TOY

TECHNICAL FIELD

The present invention relates to a water toy. More particularly, it relates to a water toy composed of a buoyant body adapted to receive the head of a user who is in the water below the toy, and at least one water gun that is controllable by a hand of the user that is in the water below the toy.

BACKGROUND OF THE INVENTION

Example water toys having a buoyant body and at least one water gun are disclosed by U.S. Pat. No. 3,823,847 granted Jul. 16, 1974, to Paul C. Wave, and by U.S. Pat. No. 5,231,951, granted Aug. 3, 1993, to Leon H. Tagar and William R. Storey. The water toys shown by these patents are in the form of a boat or raft in which a user sets or lays. A water gun is mounted on the buoyant body in front of the user and includes a hand operated water pump. There is a need for a water-gun type water toy that better stimulates the imagination of the user than do the prior art water toys. An object of the present invention is to provide such a water toy and make it look like a water animal, fish, bird, boat, submarine, or some other object, adding to the enjoyment of the toy's use and enhancing the entertainment its use provides to others.

BRIEF SUMMARY OF THE INVENTION

The present invention relates to the provision of a buoyant body that has an inner cavity adapted to receive the head of a user. The user puts his/her head into the cavity from below the buoyant body. At least one water gun is mounted on a lower portion of the buoyant body. It includes a discharge portion above the water and a control portion in the water below the buoyant body. The upper portion of the buoyant body includes a sight opening through which the user can look while maneuvering the buoyant body and operating the water gun(s). In preferred form, the buoyant body simulates a water animal, such as an octopus, or a boat, or a submarine.

The water toy of the present invention is basically characterized by a buoyant body having a lower portion that is adapted to float on a body of water, and an upper portion that is connected to the lower portion and extends upwardly from it. The upper portion includes top and side walls forming an inner cavity. The lower portion includes a bottom opening that provides an entrance into the inner cavity. The bottom opening and the cavity are sufficiently large to receive the head of a user. The upper portion includes at least one sight opening through which the user cavity can look. At least one water gun is mounted on the buoyant body. The water gun has a water-discharging portion above the water, a pump for pumping Water up to and out through the water-discharging portion, and a hand operated control portion positioned to be grasped by and operated by a hand of the user. The user can use the control to operate the pump to cause water to discharge from the water-discharging portion of the water gun.

The lower portion of the buoyant body is an inflatable structure that includes the bottom opening. The upper portion has a lower end that is connected to the lower portion substantially about the bottom opening. The lower portion is inflatable to make the buoyant body buoyant. The upper portion is inflatable to give it a stand up form whereby it stands up from the lower portion.

In preferred form, the lower portion includes a second opening that is spaced laterally from the bottom opening. A water gun is situated in the second opening with its discharge portion above the lower portion of the buoyant body and its hand operated control portion positioned in the water below the buoyant body. If desired, the water toy may be provided with a second water gun that is on the second side of the buoyant body in a position to be operated by the user's other hand.

In the preferred embodiment, the buoyant body is made to represent an octopus. The lower portion of the buoyant body includes simulated tentacles. The upper portion of the buoyant body includes a simulated octopus head.

These and other objects, advantages and features of the invention will become apparent from the detailed description of an example embodiment of the invention that follows.

BRIEF DESCRIPTION OF THE DRAWINGS

In the drawings, like reference numerals I refer to like parts throughout the several views, and:

FIG. 3 is another pictorial view of the water toy shown by FIGS. 1 and 2, such view looking LIP from below the toy towards the front end, one-side and bottom of the toy, and showing a bottom opening leading into a head-receiving cavity in the toy;

FIG. 4 is a pictorial view of an example water gun, such view being taken from above and looking towards the top, one-side and the front of the water gun;

FIG. 5 is a view like FIG. 4 but with the foreground portion of the water gun removed for the purpose of illustrating the inner construction of the water gun;

DETAILED DESCRIPTION OF THE INVENTION

Figure 1:
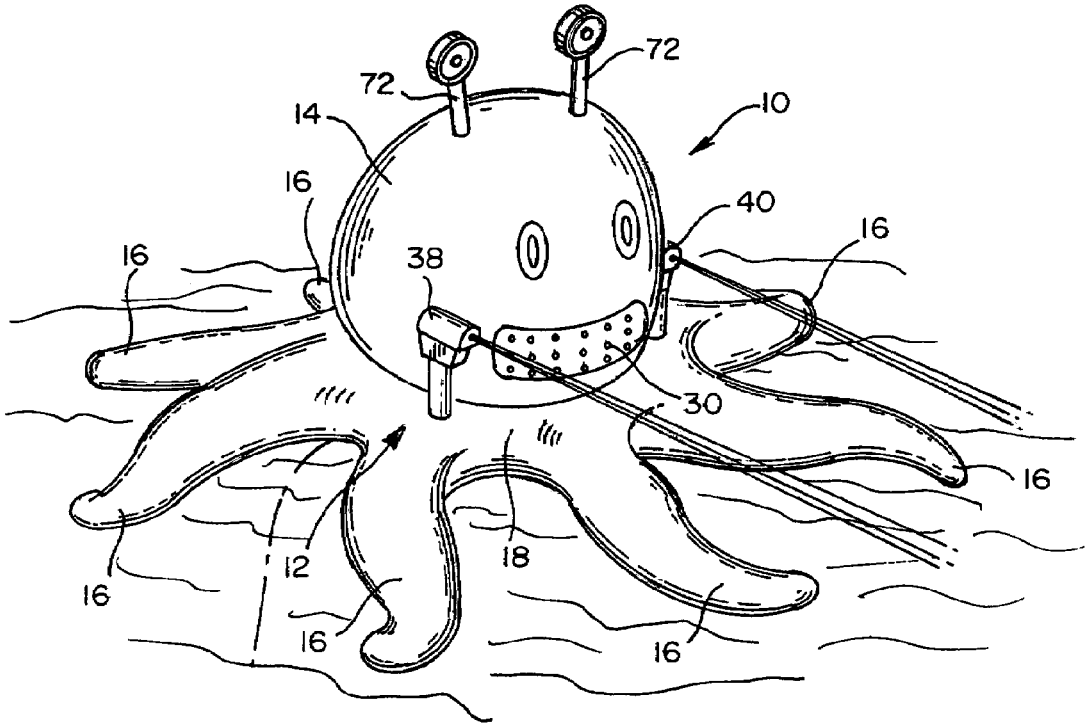
FIG. 1 is a pictorial view of a water toy in the form of a floating octopus, said view being taken from above and looking towards the front and one-side of the toy, and showing two water guns, one on each side of the toy, and further showing streams of water discharging from the water guns.
Figure 2:
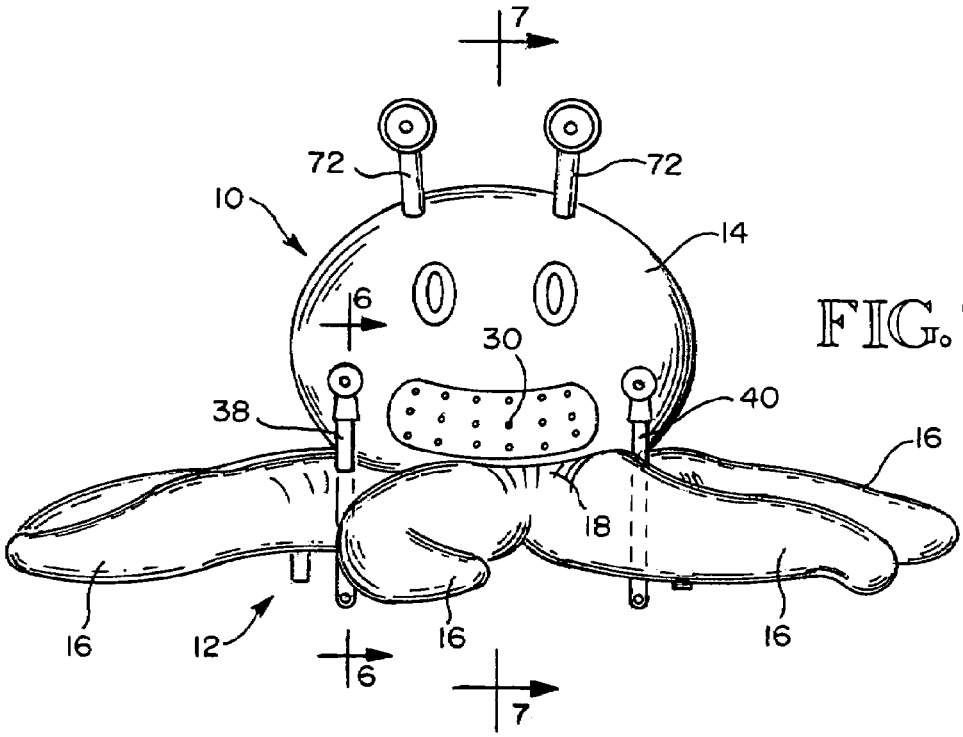
FIG. 2 is a front elevational view of the water toy shown by FIG. 1.
Figure 7:
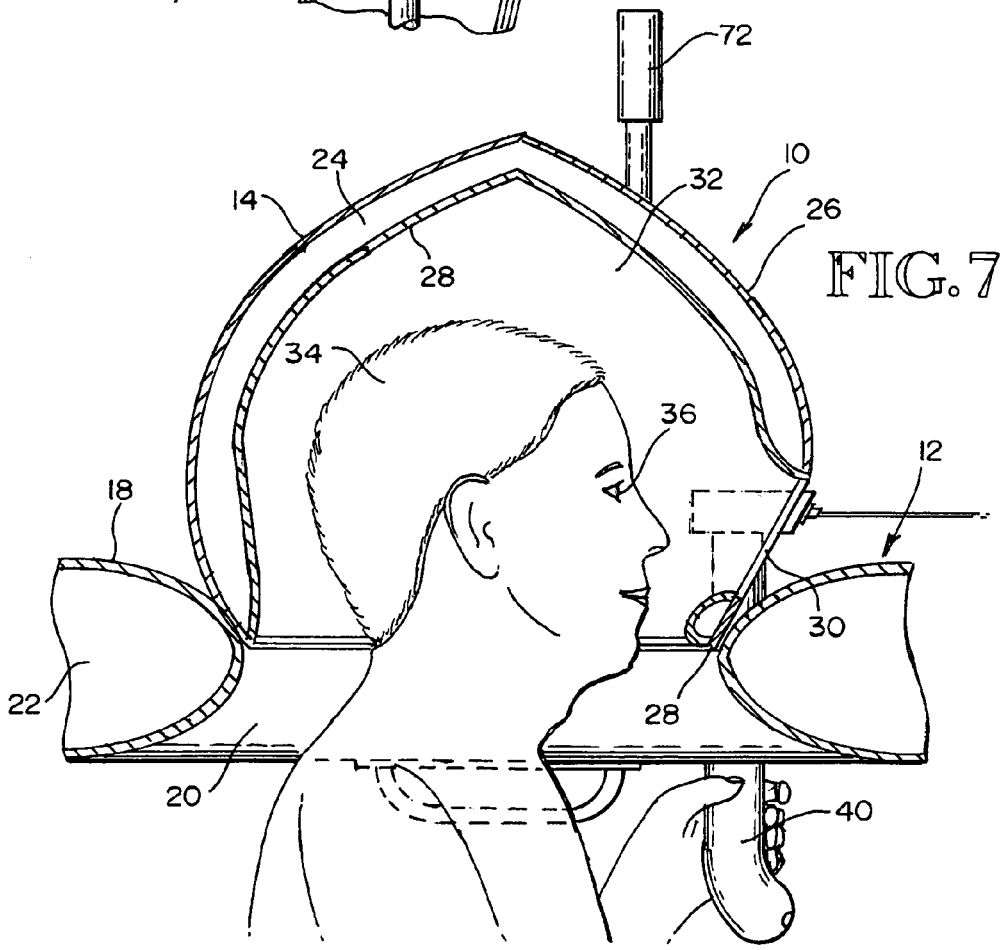
FIG. 7 is a fragmentary sectional view of a central region of the water toy shown by FIGS. 1-3, such view showing the head of a user positioned inside of the head-receiving cavity and showing the user's hand on the control for a water gun.

FIGS. 1-3 show an embodiment of the invention in which the water toy 10 simulates a floating octopus, having a lower portion 12 and an upper portion 14. The lower portion 12 includes simulated tentacles 16 which extend somewhat radially out from a central region 18 that includes a bottom opening 20 (FIG. 3). The opening 20 is positioned centrally of the lower portion 18. Lower portion 18 is formed from a flexible plastic sheet material that forms a closed figure that can contain air under pressure in a chamber 22 (FIG. 7). The inner chamber 22 is completely closed by the plastic sheet material and it includes a suitable inlet (not shown) through which inflation air may be introduced. The air enters into chamber 22, filling it up, and also filling up the interior of the tentacles 16. Inflation of the lower portion 12 makes the body 16, 18 buoyant. The upper portion 14 of the buoyant body is preferably also inflatable, but not for the purpose of providing buoyancy to the toy. It includes an air chamber 24 (FIG. 7) which extends either partially or entirely around the upper portion 14 and over its top. When pressurized air is in the chamber 24, the upper portion 14 is caused to stand up from the lower portion 12. That is, pressurized air in the chamber 24 gives the upper portion stand up rigidity, causing it to take the shape shown by FIGS. 1, 2, and 7.

As shown by FIG. 7, the upper portion 14 is in the form of a dome. It is formed by side and top walls of the sheet plastic. In the illustrated embodiment, the upper portion 14 comprises an outer wall part 26 and an inner wall part 28. The wall parts 26, 28 are joined at the bottom of the upper portion 14 at a lower edge 28. Preferably, this lower edge 28 is connected to part 18 of the lower portion 12, at a location within opening 20, as shown by FIG. 7.

In the illustrated embodiment, a window is provided at 30. Window 30 includes a surrounding edge to which the wall parts 26, 28 are attached (FIG. 7).

Bottom opening 18 forms an entrance into a cavity 32 that is formed by and within the upper portion 14. A user places his/her head in cavity 32 by inserting it through the opening 20 and then moving it upwardly into the cavity 32. As shown by FIG. 3, when the user's head 34 is in the cavity 32, the user's eyes 36 are positioned to look through the window 30.

One or two water guns 38, 40 are mounted on the buoyant body, preferably in the region 18 of the lower potion 12. A vertical opening 32 is formed in the lower portion of the buoyant body to function as a mount for a water gun 38, 40. At the location of each mounting opening, a wall part 44 of the flexible plastic material is adapted to form a vertical opening for receiving a portion of the water gun 38, 40. FIGS. 4 and 5 show a water gun 38, 40 detached from the buoyant body. As best illustrated by FIG. 5, each water gun 38, 40 may include a vertically elongated housing 42 in which a pump assembly 44 is located. The pump assembly 44 includes an inlet tube 46 and an outlet tube 48, including a discharging portion 50 for the water gun 38, 40. A finger operated pump 52 functions, in response to trigger 54 being depressed, moves water from the water inlet 56 upwardly through tubular portion 46, then to the pump 52, and then through the tubular portion 48 and then out from the discharge portion 50. The construction of the pump is quite well-known and conventional and does not have to be described in any great detail. The principles of the pump operation are disclosed in the afore-mentioned U.S. Pat. No. 3,823,847.

Figure 6:
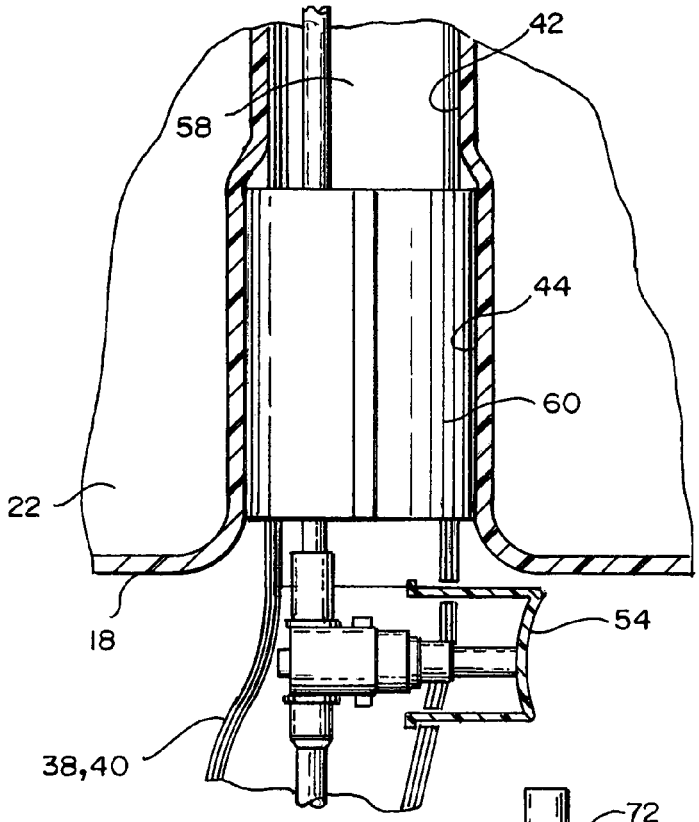
FIG. 6 is a fragmentary, partially in section and partially in side elevation, such view showing a way of attaching a water gun to the body of the water toy.

FIG. 4 shows the tubular central portion 58 of the pump 38, 40 provided with a split bearing 60. The split bearing 60 can be opened up at the split 62 and then placed on to the tubular part 58. The split bearing 60 is inserted into the vertical opening 44, as shown in FIG. 6. A tight fit of split bearing 60 in the vertical opening secures the pump 38, 40 to the opening 44, causing it to assume the position shown in FIGS. 1, 2, 6 and 7. The discharging portion of each water gun 38, 40 is positioned above the central part 18 of the lower portion 12 of the rotation body. The lower portion of the tubular structure 58 extends downwardly through the opening 44 and places the grip portion 64 of the water gun 38, 40 and the trigger 54 in the water below the lower portion 12 (FIGS. 3 and 7). In the illustrated embodiment, two water guns, 38, 40 are provided, one on each side of the water toy 10. Water gun 38 is positioned where it can be controlled by the right hand of the person whose head is in the cavity. The left hand of the same person grasps onto and controls the hand control for the second water pistol 40. The tubular portions 58 of the water guns 38, 40 can rotate within the bearings 60. The user 34 need only rotate the tube 38, by movement of the hand control, in order to change the discharge direction of the water stream.

Referring to FIG. 3, one or more handles 70 may be provided on the lower side of the lower portion 12 of the buoyant body. These handles 70 may be used when the toy is placed into or removed from the water, and for carrying the toy when it is out of the water. The handle 70 may also be used by the user for rotating the toy while it is floating in the water.

The water toy of the invention may be made to simulate something other than an Octopus. For example, it may simulate a whale, a shark, a sea turtle, a sea serpent, a sea horse, a swan or other bird, or some other animal form. Also, the toy can be made to simulate a boat or a submarine or the like. Targets 72 may be provided on top of the toy, or at some other location on the toy.

Although the preferred embodiment has been illustrated and described, and other embodiments have been described, it is to be understood by those skilled in the art to which this invention is addressed that various changes, modifications, additions and omissions in form and detail may be made without departing from the spirit and/or scope of the present invention as defined by the following claims.

What is claimed is:

1. A water toy, comprising:

a buoyant body having a lower portion adapted to float on a body of water, and an upper portion connected to the lower portion and extending upwardly from it;

said upper portion including top and side walls forming an inner cavity, said lower portion including a bottom opening entering into said inner cavity;

said bottom opening and said cavity being sufficiently large to receive the head of a person;

said upper portion including at least one sight opening through which a person whose head is in the cavity can look;

at least one water gun mounted on the buoyant body, said water gun having a water discharging portion above the water, a pump for pumping water up to and out through the water discharging portion, and a hand operated control portion positioned to be grasped by and operated by a hand of a person whose head is in the cavity;

whereby said person can use the control to operate the pump to cause water to discharge from the water discharging portion of the water gun wherein the lower portion of the buoyant body is an inflatable structure that includes said bottom opening, and said upper portion has a lower end that is connected to the lower portion substantially about the bottom opening, said lower portion being inflatable to make the buoyant body buoyant, and said upper portion being inflatable to give it a stand up form whereby it stands up from the lower portion.

2. The water toy of claim 1, wherein the lower portion includes a second opening spaced from the bottom opening, wherein said water gun is situated in the second opening, with its discharging portion above the lower portion of the buoyant body and its hand operated control portion positioned in the water below the buoyant body.

3. The water toy of claim 1, wherein the buoyant body simulates an animal form, and the upper portion of the buoyant body depicts an upper portion of the animal form.

4. The water toy of claim 3, wherein the lower portion of the buoyant body is an inflatable structure that includes said bottom opening, and said upper portion is connected to the lower portion substantially about the bottom opening, said lower portion being inflatable to make the buoyant body buoyant and said upper portion being inflatable to give it a stand up form whereby it stands up from the lower portion.

5. The water toy of claim 4, wherein the lower portion includes a second opening spaced from the bottom opening, wherein said water gun is situated in the second opening, with its discharging portion above the lower portion of the buoyant body and its hand operated control portion positioned in the water below the buoyant body.

6. The water toy of claim 3, wherein the buoyant body resembles an octopus, and the lower portion of the buoyant body includes simulated tentacles, and the upper portion of the buoyant body includes a simulated head of the octopus.

7. The water toy of claim 6, wherein the lower portion of the buoyant body is an inflatable structure that includes said bottom opening and said upper portion is connected to the lower portion substantially about the bottom opening, said lower portion being inflatable to make the buoyant body buoyant, and said upper portion being inflatable to give it a stand up form whereby it stands up from the lower portion.

8. A water toy of claim 1, wherein the lower portion includes a second opening on one side of the bottom opening and a third opening on the other side of the bottom opening, wherein a first water gun is situated in the second opening, with its discharging portion above the lower portion of the buoyant body and its hand operated control portion positioned in the water below the buoyant body, and wherein a second water gun is situated in the third opening, with its discharging portion above the lower portion of the buoyant body and its hand operated control portion positioned in the water below the buoyant body.

9. The water toy of claim 8, wherein the buoyant body resembles an octopus, and the lower portion of the buoyant body includes simulated tentacles and the upper portion of the buoyant body includes a simulated head of the octopus.

* * * * *